US005643524A

United States Patent [19]

Gilbert De Cauwer et al.

[11] Patent Number: 5,643,524

[45] Date of Patent: Jul. 1, 1997

[54] CORONA CHARGING OF FLASH SPUN PLEXIFILAMENTARY FILM-FIBRIL WEBS IN POOR CHARGING ENVIRONMENTS

[75] Inventors: Jacques Gilbert De Cauwer, Reichlange; Ottmar Niederpruem, Dalheim; Michel Stachnik; Jean Francois Woll, both of Luxembourg, all of Luxembourg; Thomas Bednarz, Richmond, Va.

[73] Assignee: E. I. Du Pont de Nemours and Company, Wilmington, Del.

[21] Appl. No.: 460,564

[22] Filed: Jun. 2, 1995

Related U.S. Application Data

[63] Continuation of Ser. No. 367,367, Dec. 30, 1994, abandoned.

[51] Int. Cl.[6] ..... D01D 5/11

[52] U.S. Cl. ..... 264/441; 264/465; 264/39; 264/205; 425/72.2; 425/174.8 E; 425/229

[58] Field of Search ..... 264/469, 438–442, 264/483, 465–468, 12, 39, 205; 425/174.8 E, 174.8 R, 174, 72.2, 225, 229, 232, 227

[56] References Cited

U.S. PATENT DOCUMENTS

| | | | |
|---|---|---|---|
| 3,163,753 | 12/1964 | Di Sabato et al. | 264/438 |
| 3,387,326 | 6/1968 | Hollberg et al. | 264/441 |
| 3,456,156 | 7/1969 | Kilby et al. | 425/174.8 E |
| 3,549,453 | 12/1970 | Smith | 425/231 |
| 3,565,979 | 2/1971 | Palmer | 264/169 |
| 3,578,739 | 5/1971 | George | 425/174.8 E |
| 3,593,074 | 7/1971 | Isakoff | 264/441 |
| 3,689,608 | 9/1972 | Hollberg et al. | 264/441 |
| 4,157,236 | 6/1979 | Busker et al. | 425/232 |
| 5,296,172 | 3/1994 | Davis et al. | 425/174.8 E |
| 5,400,458 | 3/1995 | Rambosek | 15/179 |

FOREIGN PATENT DOCUMENTS

| | | | |
|---|---|---|---|
| WO9014172 | 11/1990 | WIPO | 425/227 |
| WO9423097 | 10/1994 | WIPO | 264/465 |

*Primary Examiner*—Jeffery R. Thurlow

[57] ABSTRACT

This invention relates to flash spinning a plexifilamentary film-fibril strand and laying it down into sheet material including the step of subjecting the strand to an electrostatic charge. The invention is particularly focused on cleaning, and maintaining clean, the target plate of the electrostatic charging system by scrubbing or scouring the surface of the target plate with a highly abrasive brush moving at a relatively high speed. The target plate is selected to be abrasion resistant.

25 Claims, 3 Drawing Sheets

CORONA CHARGING OF FLASH SPUN PLEXIFILAMENTARY FILM-FIBRIL WEBS IN POOR CHARGING ENVIRONMENTS

RELATED CASE

This is a Continuation application of Ser. No. 08/367,367, filed Dec. 30, 1994, now abandoned.

FIELD OF THE INVENTION

This invention relates to corona charging of spun fiber and especially to corona charging of fiber in a flash spinning process which produces plexifilamentary film-fibril webs or strands and more especially to a method and apparatus for electrostatically charging a strand or web of plexifilamentary film-fibril from a flash spinning process.

BACKGROUND OF THE INVENTION

The process of forming plexifilamentary film-fibril strands and forming the same into non-woven sheet material has been disclosed and extensively discussed in U.S. Pat. No. 3,081,519 to Blades et al., U.S. Pat. No. 3,227,794 to R. D. Anderson et al., U.S. Pat. No. 3,169,899 to Steuber, U.S. Pat. No. 3,851,023 to Brethauer et al. and U.S. Pat. No. 3,387,326 to Hollberg et al., all of which are incorporated by reference herein. This process and various improvements thereof have been practiced for a number of years by E. I. du Pont de Nemours and Company (DuPont) in the manufacture of Tyvek® spunbonded olefin.

Part of the foregoing manufacturing process includes a step of applying an electrostatic charge to a flattened and partially spread open plexifilamentary film-fibril strand after it is spun at a spin pack and before it is laid down on a conveyor belt. Electrostatic charges are thereby applied to the individual fibrils which cause the fibrils to repel one another, thus maintaining the separation of the fibrils in a spread apart form. The flattened strand (or probably more accurately described as a plexifilamentary film-fibril web once the strand has been flattened) is then suited to being laid down, along with other webs from adjacent spin packs onto a conveyor to form a sheet. Without the electrostatic charge, the web tends to draw together before it can be laid down causing numerous defects and very poor quality sheet products. The conveyor may also be provided with an electrostatic charge opposite to the charge on the strand thereby improving the attraction force to the conveyor and improving pinning on the conveyor. The process of applying a charge to the webs has worked quite satisfactorily in the current arrangements, although the equipment for applying the charges continue to require improvements in a number of areas.

In spite of the success and satisfaction with the overall flash spinning process and system, the process includes the use of perchlorofluorocarbon (CFC) solvents which are currently believed to cause ozone depletion and the use of which will soon be legislatively foreclosed. Accordingly, alterative solvents having suitable performance characteristics in the flash-spinning process are being aggressively sought. DuPont has expended considerable resources developing alternative solvents and has focused on several that may eventually be used commercially. As might be expected, the different solvents require some modifications in the manufacturing process or present problems that did not exist using the CFC solvents.

Hydrocarbon solvents are currently considered the most attractive alternatives to the potentially ozone depleting solvents presently in use. However, the resulting hydrocarbon atmosphere, into which the strands are spun, causes a lower charge current efficiency for the electrostatic charge applying equipment. In other words, in the process of manufacturing flash spun polyolefins, the use of promising hydrocarbon solvents reduces the effective electrostatic charge applied to the web passing through the electrostatic field for a given current as compared to the same process using a conventional CFC solvent. As a result, the webs would not be as fully opened up and the resulting non-woven sheet is less uniform than a sheet formed of more fully charged webs. Sheet uniformity is an important issue for product quality and has a substantial effect on the value of the product.

In actuality, an adequate charge can be applied to the webs by increasing the power delivered to the electrostatic charge applying equipment. However, there is a limit to the energy that can be put into the system prior to the corona field breaking down and electric arcs forming between the needles and the target plate. Also, the increased energy level causes rapid deterioration of the elastomeric coating on conventional target plates substantially decreasing pack life. The substantial expense of such short term pack life will cause unacceptable costs for the manufacture of Tyvek® material. Target plate fouling and deterioration are predicted to substantially reduce the duration for which the spin pack may be operational in a spin cell leading to substantial production cost increases.

Even if deterioration of the target plates may be resolved (such as using a metal target plate, see U.S. Pat. No. 3,578,739 to George), target plates do become fouled with a coating of polymer residue during the flash spinning process and the increased energy input increases the rate of fouling. The residue coating reduces the charging efficiency and the charging current is increased to maintain the desired charge on the web, further exacerbating the problem of fouling. When the target plate is sufficiently fouled, the system becomes unable to apply a charge to the web regardless of the charging current applied to the system. As noted above, when the electrostatic charging system for a spin pack fails, the spin pack must be shut down and replaced else it will likely create many defects in the web. Fortunately, replacement of spin packs may be accomplished during continued production of sheet material by adjusting adjacent spin packs. However, if an adjacent spin pack becomes inoperative during the replacement process, production of the sheet material is likely to be shutdown. Production shutdowns seriously effect profitability, so the average pack life of a spin pack seriously effects the economics of production.

Accordingly, it is a primary object of the present invention to provide a method and system for applying an electrostatic charge to a web in a flash spinning production operation which avoids the drawbacks as described above.

It is a more particular object of the present invention to provide a method and system for applying an electrostatic charge to a web in a flash spinning production operations which has a greater resistance to fouling as compared to current methods and systems.

SUMMARY OF THE INVENTION

The objects of the present invention are accomplished by a method and apparatus which comprises a target plate mounted along a path of travel of the web wherein the target plate includes an extensive face surface. The face surface is arranged generally parallel to the path of the travel of the web and includes portions adjacent the web and portions which are away from the path of the web. An ion gun having at least one corona source element is positioned opposite from the adjacent portion of the face surface of the target plate at a predetermined distance therefrom. A corona field is created between the corona source elements and the adjacent portion of the face surface of the target plate. The target plate is moved such that other portions of the face surface of the target plate are moved into closer proximity of the corona source element and the corona field is thereby directed upon a such other portions of the face surface of the target plate. At the same time, the portion of the face surface which was formerly adjacent the path of the web is moved into a cleaning zone. At least a portion of a plexifilamentary film-fibril web is passed through at least a portion of the corona field so as to acquire electrostatically charged particles thereon. The face surface of the target plate is scrubbed with a highly abrasive brush within the cleaning zone such that the highly abrasive brush cleans or removes from the face surface polymer residue and other debris that may have collected thereon. The highly abrasive brush is arranged to have the ends of the bristles pass across the face surface of the plate at a relative speed of at least about 2.5 meters per second.

BRIEF DESCRIPTION OF THE DRAWINGS

The invention will be more easily understood by a detailed explanation thereof which includes drawings to illustrate the features of the invention. Accordingly, such drawings are attached herewith and are briefly described as follows.

DETAILED DESCRIPTION OF THE PREFERRED EMBODIMENT

Figure 1:
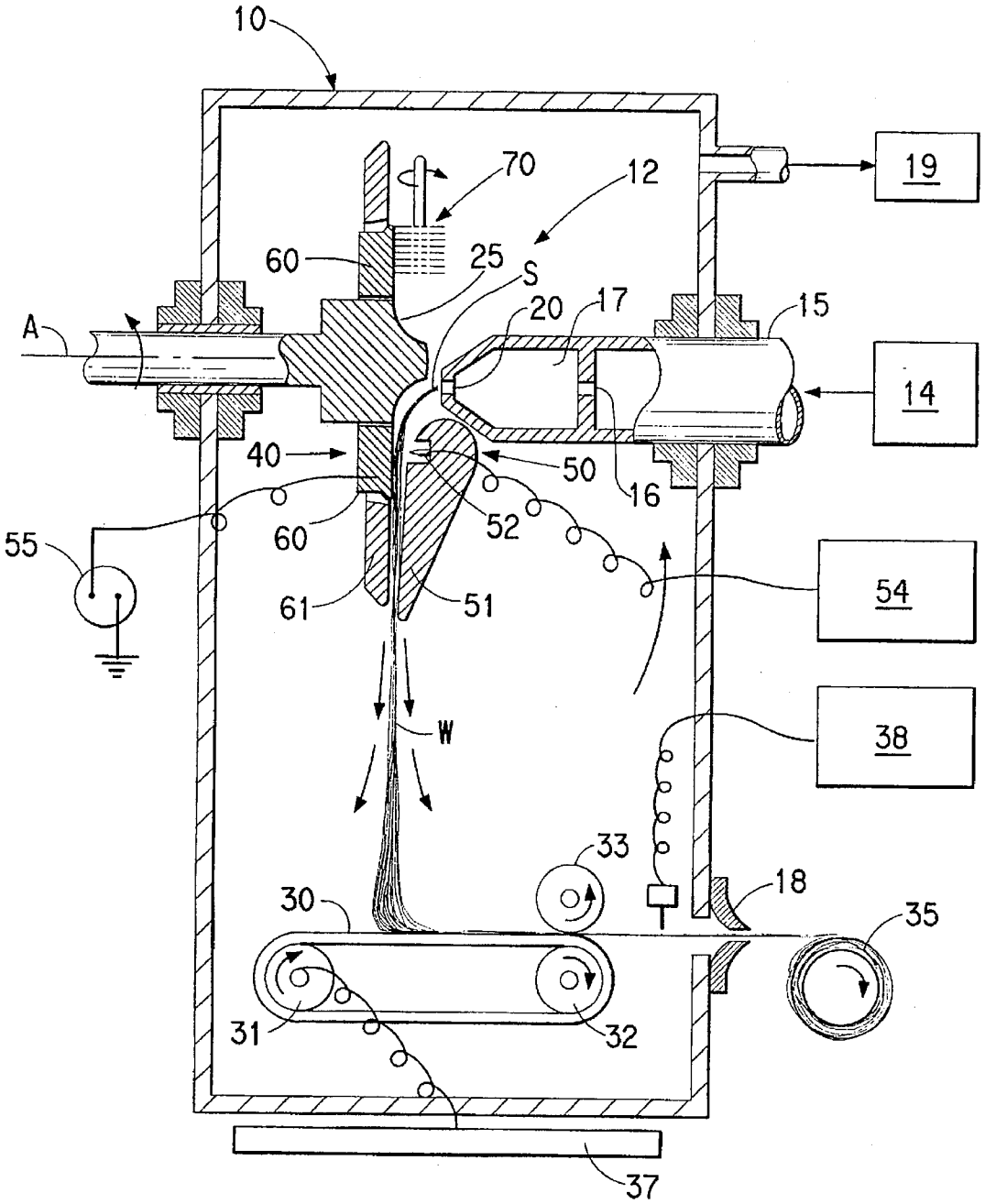
FIG. 1 is a simplified fragmentary cross sectional elevational view of the preferred embodiment of the invention.

Turning now to the drawings, the invention may be more easily understood by directing one's attention to FIG. 1. In FIG. 1, there is generally indicated a spin cell 10 which includes a single spinpack, generally indicated by the number 12, a material exit 18 and an exhaust vent 19. The spinpack 12 is part of a flash spinning apparatus which includes a solutioning system schematically indicated by the number 14 which mixes the polymer and solvent at high pressure and temperature to form a single phase spinning solution. The spinning solution is provided to spinpack 12 through a conduit 15. In the present invention, as noted above, the spinning solution comprises a different solvent as compared to conventional systems. In particular, the preferred solvent is a substantially CFC-free solvent. Other patent applications have been filed related to particulars of the solvent as exemplified by U.S. Pat. Nos. 5,021,123, 5,147,586, and 5,250,237 and U.S. patent application Ser. No. 08/218,479 which are all incorporated by reference herein. In the presently planned commercial production system, normal pentane has been selected as the alternative solvent to Freon 11 and is presently preferred. As alluded to above, hydrocarbons, including pentane, inhibit the effectiveness of the electrostatic charging subsystem and is a matter of very serious concern as it relates to producing quality sheet product, as will be described below.

Continuing with the description of the invention, the polymer solution is provided through the conduit 15 into the spinpack 12 at high pressure and temperature. The solution passes through a letdown orifice 16 where it enters into a letdown chamber 17. In the letdown chamber 17, the solution is allowed to drop to a predetermined lower pressure which causes the polymer solution to change to a two phase mixture. The two phase mixture is ejected through a polymer spinning outlet 20 into an environment of near ambient pressure and slightly elevated temperature, both of which are much lower than the pressure and temperature of the solutioning system and the letdown chamber 17. At the polymer spinning outlet 20, the solvent instantaneously evaporates (or flashes) and the polymer hardens into the high surface area, spiderweb-like network that is described as a plexifilamentary film-fibril strand S.

The polymer strand S is emitted from the orifice 20 at a very high rate of speed and is directed to a baffle 25. The impact with the baffle 25 causes the strand S to flatten into a spread apart web W and also diverts the web W downwardly between shields 51 and 61 toward a belt 30. The baffle 25 rotates about an axis A at a high rate and has a shape that not only flattens the web, but also causes the web W to take an oscillating or back and forth path crosswise relative to the belt 30 so as to spread out the web W across the belt 30 in a somewhat randomly laid down array of continuous fiber. The array may then be pressed together to form a sheet material. The belt 30 is supported by rolls 31 and 32 and a press roll 33 is arranged in conjunction with roll 32 to press the array of fiber laid on the belt. The sheet material is illustrated as being rolled up on roll 35. The material may be further processed to enhance or create certain characteristics such as porosity, softness, printability, texture, etc.

Figure 3:
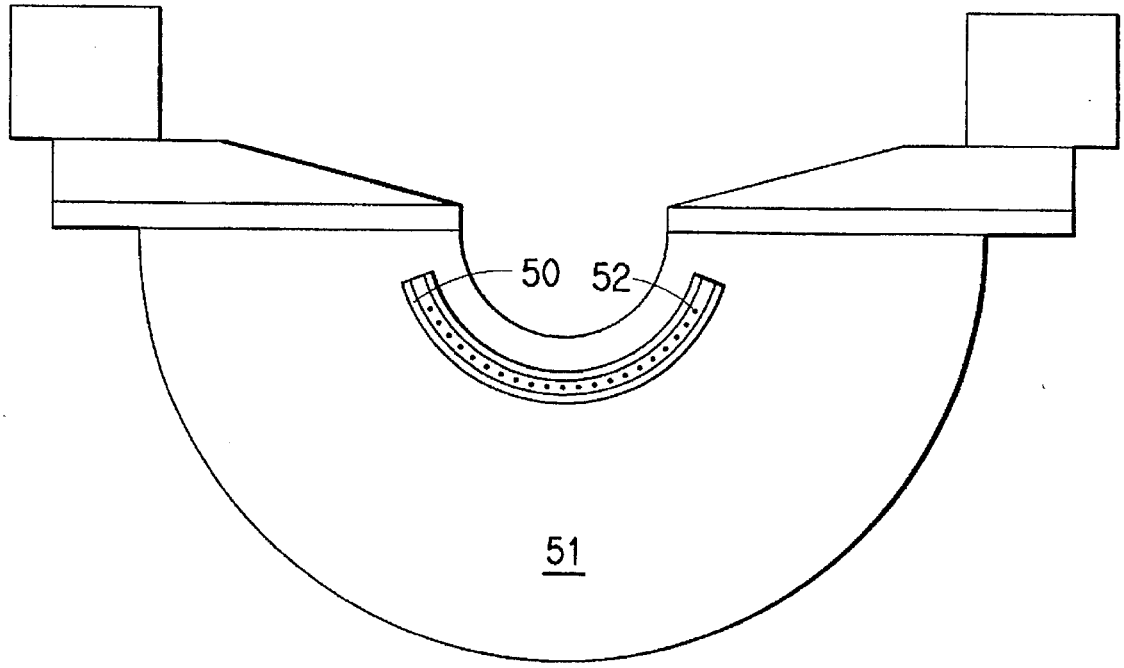
FIG. 3 is a front elevation view taken from the perspective of line 3—3 in FIG. 2.

An electrostatic charging subsystem is generally indicated by the number 40. The electrostatic charging subsystem 40 comprises a multi-needle ion gun generally indicated by the number 50 and mounted in a recess within front shield 51. The multi-needle ion gun 50 includes a plurality of needles 52 arrayed in an arc as illustrated in FIG. 3. Each of the needles 52 is connected to a DC voltage source schematically indicated by the number 54. A target plate 60 is spaced from the needles 52 so as to allow the web W to pass therebetween and on toward the belt 30 between shields 51 and 61. The target plate 60 includes a generally planar face surface 62 facing toward both the path of travel of the web and the ion gun 50. The target plate 60 is preferably mounted by suitable means (not shown) so as to rotate about axis A but at a rate substantially different and slower rate than baffle 25. The target plate 60 preferably rotates at about 2 to 15 rpm although higher and lower speeds may be suitable. The target plate 60 is connected to ground potential via a microammeter 55. The DC voltage source 54 provides a generally constant electric potential so as to create an electrostatic corona field from the needles to the conductive target plate 60. The web W accumulates charges from the corona field as it passes therethrough.

As noted above, the web is provided with a charge. The charge makes the web attracted to the belt which may have a neutral charge, or more preferably, the belt 30 may be provided with an electrostatic potential charge opposite to that which has been applied to the web W. In the illustrated embodiment, the source 37 provides the charge to the belt. The electrostatic charge on the web W and the belt 30 may thereafter be dissipated or neutralized by source 38.

Figure 2:
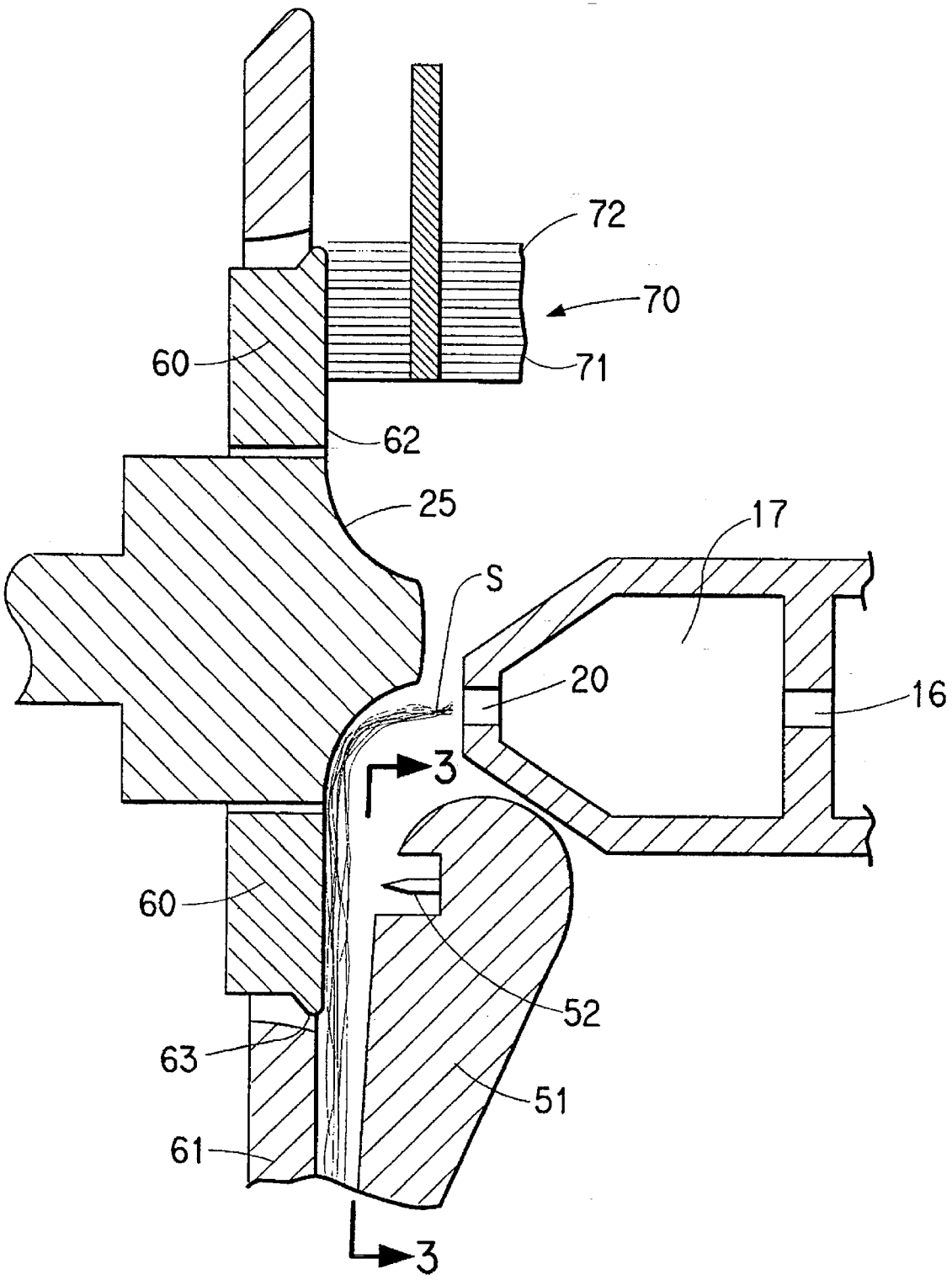
FIG. 2 is an enlarged fragmentary cross sectional elevational view similar to FIG. 1 focusing on the highly abrasive brush being arranged to clean the face surface and peripheral edge of the target plate.

During the spinning process, polymer residue coats most of the equipment in the spin cell 10. The residue is particularly attracted to the charged target plate 60. As described above, such coating of the target plate has serious deleterious effects on the performance of the electrostatic charge applying system. In order to maintain the face surface of the target plate 60 free from polymer residue and other debris, the face surface 62 is scrubbed or scoured with a highly abrasive brush 70. The highly abrasive brush is positioned in a cleaning zone which is spaced from the ion gun 50 outside the corona field on the face surface of the target plate such that the brush cleans and removes from the face surface of the target plate any polymer residue or other debris which many have been deposited as the face surface slowly rotates through the corona field about the target plate axis. In addition to cleaning the face surface 62 of the target plate, it is also desirable to clean the peripheral edge 63 of the target plate 60. To accomplish such edge cleaning, the abrasive brush 70 may be contoured with a profile as shown in FIG. 2. The profile includes two different length bristles or at least one section of bristles that are contoured to clean the face and a second section of bristles to clean the edge. Preferably the first section of bristles 71 are a common length to scrub the face. A second section of bristles 72 are arranged to have a length longer than the bristles in the first section 71 and preferably all the bristles in the second section are a common length. Clearly, the brush 70 is arranged so that the sections 71 and 72 are opposed to the appropriate portion of the target plate 60. Also, as noted above, the target plate 60 is arranged to rotate so that the entire circumference of the face surface moves into contact with the bristles of the brush 70.

In the preferred arrangement of the present invention, the abrasive brush is cylindrical and rotated at a high rate of speed in order to achieve the necessary scrubbing action to satisfactorily remove the polymer residue. The brushing surface in the preferred arrangement is essentially parallel to the target plate surface with the axis of the brush generally perpendicular to the axis of the target plate 60. The brush may be run at a speed of 800 to 1800 rpm, but is preferably rotated at a speed of 1200 to 1400 rpm. Considering that the preferred size of the brush about 2.5 inches (~63 mm) in diameter provides for a surface speed of approximately 2.6 to 6.0 meters per second as the expected operating range of the invention with 3.9 to 4.7 meters per second being preferred. The rotating brush 70 contacts the face surface of the target plate 60 in a way that achieves a good scrubbing or scouring action and also tends to "flick" any debris from the plate off the bristle. Thus any debris or residue that may have adhered to the bristle is jarred loose. Preferably the brush is set with an interference of between 0.25 and 1.27 millimeters with the face surface 62.

The highly abrasive brush comprises bristles such as nylon which contain abrasive particles. Such abrasive bristles are made by DuPont under the tradename TYNEX A. TYNEX A comprises bristles made of nylon 6,12 which maintains good stiffness at the temperature of the spin cell 10 plus any increase due to the frictional heat that may build up during operation. TYNEX A is also noted for having high particle loading carrying generally in the range of 20 to 30% loading. Various choices of abrasive particles are available such as aluminum oxide and silicon carbide; however, silicon carbide abrasive particles are generally preferred. The preferred choice in particle size is generally between 100 grit and 1000 grit. Higher grits mean smaller particle size and therefore such higher grit brush tend to polish and not remove the debris and residue. Lower grits have larger size particles and tend to scrape too deeply into the target plate causing excessive scarring and wear and also tend to deposit the eroded target plate material into the product which is unacceptable to many customers. The bristles, which carry the abrasive material, typically have a cross-section of at least 0.4 square millimeters.

The selection of the target plate material used in conjunction with a highly abrasive brush is very important. It should be a hard, abrasion resistant material to withstand the scrubbing or scouring action of the highly abrasive brush. Suitable materials include bronze and stainless steel. For example, stainless steel types 304 and 316 are suitable choices; however, they have shown some wear in use. Wear resistance of the target plate 60 can be markedly improved by providing a coating of tungsten carbide and more preferably, tungsten carbide containing cobalt. Alternatively, the entire target plate 60 may be formed of tungsten carbide or titanium nitride. It would also be desirable to provide a suitable conductive ceramic target plate that is wear and abrasion resistant.

The foregoing description of the invention has been to provide a more clear understanding of the technology of the invention and has not been provided to limit or narrow the scope of protection afforded by the patent laws. The scope of protection should be ascertained from the claims that follow.

We claim:

1. A process for electrostatically charging flash spun polymer plexifilamentary film fibril webs and laying such webs into a non-woven sheet, the process comprising the steps of:

mounting a target plate along a path of travel of the web wherein the target plate includes an extensive face surface which is hard and abrasion resistant and wherein a portion of the face surface is adjacent and generally parallel to the path of travel and the remaining portions of the face surface are away from the path of travel;

locating an ion gun having at least one corona source element opposite from the adjacent portion of the face surface of the target plate at a predetermined distance therefrom;

creating a corona field between the at least one corona source element and the adjacent portion of the face surface of the target plate;

moving the target plate such that other portions of the face surface of the target plate are moved adjacent the path and a formerly adjacent portion of the target plate is moved into a cleaning zone so as to provide for cleaning of the face surface of the target plate and wherein the cleaning zone is generally outside the corona field;

directing at least a portion of a plexifilamentary film-fibril web through at least a portion of the corona field so as to acquire electrostatically charged particles thereon;

scrubbing at least a portion of the face surface of the plate with a highly abrasive brush within the cleaning zone such that the highly abrasive brush cleans or removes surface polymer residue that may have collected thereon, wherein the abrasive surface of the highly abrasive brush passes across the face surface of the plate at a relative speed of at least about 2.5 meters per second.

2. The method according to claim 1 wherein the target plate is mounted for rotation about a target plate axis and the path of the web extends parallel to the face surface of the target plate and the step of moving the target plate more particularly comprises rotating the target plate continuously about the target plate axis.

3. A process for electrostatically charging flash spun polymer plexifilamentary film fibril webs which are spun from a substantially CFC-free solvent and laid into a non-woven sheet, the process comprising the steps of:

mounting a target plate along a path of travel of the web wherein the target plate includes an extensive face surface which is hard and abrasion resistant and wherein a portion of the face surface is adjacent and generally parallel to the path of travel and the remaining portions of the face surface are away from the path of travel;

locating an ion gun having at least one corona source element opposite from the adjacent portion of the face surface of the target plate at a predetermined distance therefrom;

creating a corona field between the at least one corona source element and the adjacent portion of the face surface of the target plate;

moving the target plate such that other portions of the face surface of the target plate are moved adjacent the path and a formerly adjacent portion of the target plate is moved into a cleaning zone so as to provide for cleaning of the face surface of the target plate wherein the cleaning zone is generally outside of the corona field;

directing at least a portion of a plexifilamentary film-fibril web spun from a substantially CFC-free solvent to pass through at least a portion of the corona field so as to acquire electrostatically charged particles thereon;

scrubbing at least a portion of the face surface of the plate with a highly abrasive brush within the cleaning zone such that the highly abrasive brush cleans or removes surface polymer residue that may have collected thereon, wherein the highly abrasive brush includes abrasive particles in the range of about 100 grit to 1000 grit and the abrasive surface of the brush passes across the face surface of the plate at a relative speed of at least about 2.5 meters per second up to about 6 meters per second.

4. The method according to claim 1 wherein at least the surface of the plate is a conductive ceramic material.

5. The method according to claim 1 wherein at least the surface of the plate is a stainless steel material.

6. The method according to claim 1 wherein at least the surface of the plate is a tungsten carbide material.

7. The method according to claim 1 wherein at least the surface of the plate is a titanium nitride material.

8. The method according to claim 1 wherein at least the surface of the plate is a bronze material.

9. The method according to claim 1 wherein the step of scrubbing the face surface of the target plate further comprises scrubbing the face surface with a brush having bristles made of nylon 6,12 and having an abrasive particle loading of at least 20%.

10. The method according to claim 1 wherein the bristles of the brush have a length slightly greater than the distance to the face surface of the target plate and the step of scrubbing the target plate includes flicking the bristles as the ends of the bristles lift from the face surface so as to separate by the jarring action of the flick any polymer that may have collected on the bristle from the target plate.

11. The method according to claim 1 wherein the abrasive brush includes silicon carbide abrasive particulate material in the bristles of the brush of generally between 100 grit and 1000 grit.

12. The method according to claim 1 wherein the step of scrubbing the face surface of the plate further includes scrubbing the peripheral edge of the plate.

13. The method according to claim 2 wherein the abrasive brush includes a profile to clean both the face surface and the peripheral edge of the target plate.

14. The method according to claim 13 wherein the abrasive brush is arranged to rotate about an axis which is generally perpendicular to the target plate axis.

15. A process for making a sheet material from one or more strands of polymer plexifilamentary film-fibril elements, wherein the process comprises the steps of:

spinning a plexifilamentary film-fibril strand from a solution of fiber forming polymer and solvent;

directing the strand to a baffle to flatten the strand into a web and spread the web onto a belt to form a sheet;

creating a corona field along a path of the web to the belt to provide electrostatically charged particles on the web, wherein the corona field is created between an ion gun and a face surface of a rotating target plate wherein the face surface of the target plate is hard and abrasion resistant; and scrubbing with a highly abrasive brush a portion of the face surface of the target plate to remove polymer residue and debris that may have accumulated thereon, wherein the highly abrasive brush is arranged to contact the face surface within a cleaning zone that is generally outside the corona field, and wherein the highly abrasive brush includes abrasive particles of generally between 100 grit and 1000 grit and the abrasive surface of the brush passes across the face surface of the plate at a relative speed of at least about 2.5 meters per second.

16. The method according to claim 15 wherein the step of spinning comprises spinning from a hydrocarbon based solvent.

17. A apparatus for electrostatically charging flash spun polymer plexifilamentary film-fibril web material, the apparatus comprising:

a target plate having a hard and abrasion resistant face surface and a target plate axis oriented generally perpendicular to said face surface;

means for rotating-said target plate about said target plate axis;

ion gun means spaced opposite from said face surface of said target plate at a generally predetermined distance and also spaced from said target plate axis; whereby an electrostatic charging zone is defined between said ion gun and a generally adjacent face surface portion of said target plate;

highly abrasive rotatable brush means arranged to scrub said face surface of said conductive target plate at a location generally outside of said electrostatic charging zone; and means to rotate said rotatable brush means so that the relative speed of the scrubbing portion of said brush means and said target plate is at least about 2.5 meters per second.

18. The apparatus according to claim 17 wherein said target plate is comprised of a conductive ceramic material.

19. The apparatus according to claim 17 wherein said target plate is comprised of a stainless steel material.

20. The apparatus according to claim 17 wherein said target plate is comprised of a tungsten carbide material.

21. The apparatus according to claim 18 wherein said target plate is comprised of a titanium nitride material.

22. The apparatus according to claim 18 wherein said target plate is comprised of bronze material.

23. The apparatus according to claim 17 wherein said brush means includes bristles comprising nylon 6,12 and having a cross section of about 0.4 square millimeters.

24. The apparatus according to claim 23 wherein said bristles include particles of silicon carbide abrasion material of generally between 100 grit and 1000 grit.

25. The apparatus according to claim 17 wherein said bristles have a length of generally between 0.25 mm and 1.27 mm greater than the span from the base of the brush to the face surface of the target plate to thereby provide for an interference between the bristles and the target plate and a flicking action of the bristles to clear debris that may adhere to the bristles.

* * * * *